US011659926B2

(12) United States Patent
Stevens et al.

(10) Patent No.: US 11,659,926 B2
(45) Date of Patent: May 30, 2023

(54) CABINET STORAGE SYSTEM

(71) Applicant: Rev-A-Shelf Company, LLC, Louisville, KY (US)

(72) Inventors: Leeman Elliot Stevens, Shelbyville, KY (US); Paul Franklin Chambers, Louisville, KY (US); Kevin M. Ward, Louisville, KY (US); David P. Noe, Louisville, KY (US); Steve M. Jones, Jr., Louisville, KY (US)

(73) Assignee: REV-A-SHELF COMPANY, LLC, Louisville, KY (US)

( * ) Notice: Subject to any disclaimer, the term of this patent is extended or adjusted under 35 U.S.C. 154(b) by 0 days.

(21) Appl. No.: 17/300,311

(22) Filed: Jan. 18, 2021

(65) Prior Publication Data

US 2022/0248845 A1 Aug. 11, 2022

(51) Int. Cl.

| | |
|---|---|
| ***A47B 88/40*** | (2017.01) |
| ***A47B 77/18*** | (2006.01) |
| ***B65F 1/14*** | (2006.01) |
| ***A47B 88/919*** | (2017.01) |
| *B65F 1/12* | (2006.01) |

(52) U.S. Cl.

CPC ..... *A47B 77/18* (2013.01); *A47B 88/40* (2017.01); *A47B 88/919* (2017.01); *B65F 1/1436* (2013.01); *B65F 1/12* (2013.01)

(58) Field of Classification Search

CPC ..... A47B 88/40; A47B 88/919; A47B 77/18; B65F 1/12; B65F 1/1436

See application file for complete search history.

(56) References Cited

U.S. PATENT DOCUMENTS

| | | | | |
|---|---|---|---|---|
| 4,995,682 | A * | 2/1991 | Gutner | G11B 23/0236 211/41.12 |
| D588,415 | S * | 3/2009 | Ward, Jr. | D7/601 |
| 7,886,917 | B1 * | 2/2011 | Berger | A47B 45/00 312/348.3 |
| 9,049,930 | B1 * | 6/2015 | Chambers | A47B 77/18 |
| 2009/0236958 | A1 * | 9/2009 | Klein | A47B 88/42 312/348.3 |
| 2014/0197121 | A1 * | 7/2014 | Knight | A47B 88/994 29/428 |
| 2018/0228121 | A1 * | 8/2018 | Murray | A01K 29/00 |
| 2018/0310711 | A1 * | 11/2018 | Kuhn | A47B 88/437 |

* cited by examiner

*Primary Examiner* — James O Hansen

(74) *Attorney, Agent, or Firm* — Crowell & Moring LLP

(57) ABSTRACT

A cabinet storage system includes a base and a pair of slides. The base includes a first planar surface and a second planar surface. The first and second planar surfaces are opposing surfaces of the base and define a perimeter of the base. The pair of slides are coupled with the first planar surface. The system also includes fences positioned away from the second planar surface around the perimeter of the base, and structural columns mechanically coupled with the base. The structural columns are positioned to abut the second planar surface and longitudinally extending away from the second planar surface to rigidly maintain the fences around the perimeter of the base.

16 Claims, 21 Drawing Sheets

CABINET STORAGE SYSTEM

FIELD

The present disclosure relates generally to a cabinet storage system for use in a cabinet or other enclosure.

BACKGROUND

Cabinets such as storage cabinets for kitchens, bathrooms, closets, offices and other uses can include one or more receptacles, such as drawers or shelves for storing articles. The drawers and shelves can be designed to be moved between an open position and a closed position. While in the open position, a drawer or shelf may be extended away from the storage cabinet or other enclosure so as to receive the articles. In the closed position, the drawer or shelf may be recessed within the storage cabinet or other enclosure in which the drawer or shelve is installed. The size and weight of such drawers or shelves can vary. In addition, the weight, type, and/or number of articles that can be stored on the drawers or shelves can be quite different in different applications.

DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
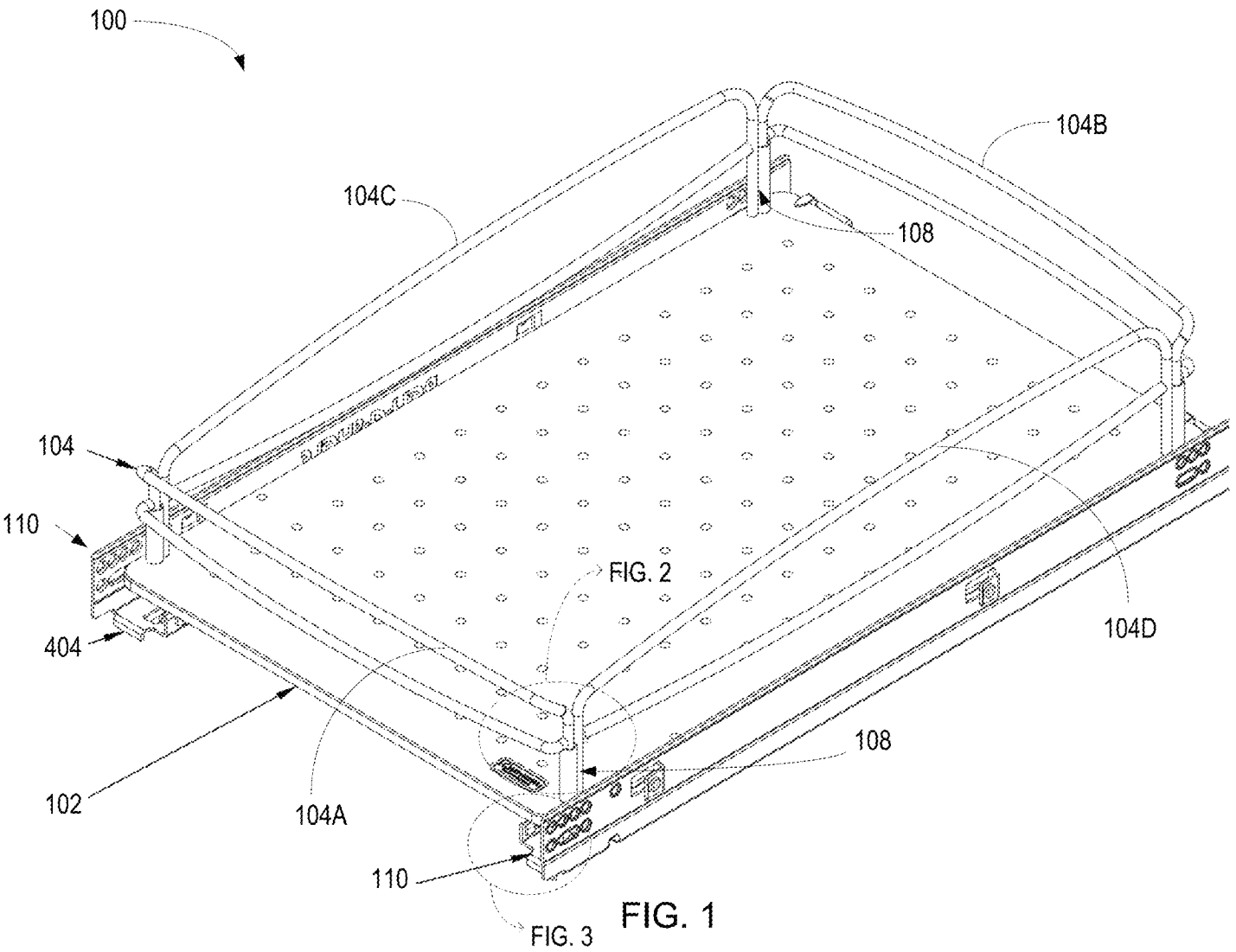
FIG. 1 is a perspective view of an example cabinet storage system.
Figure 21:
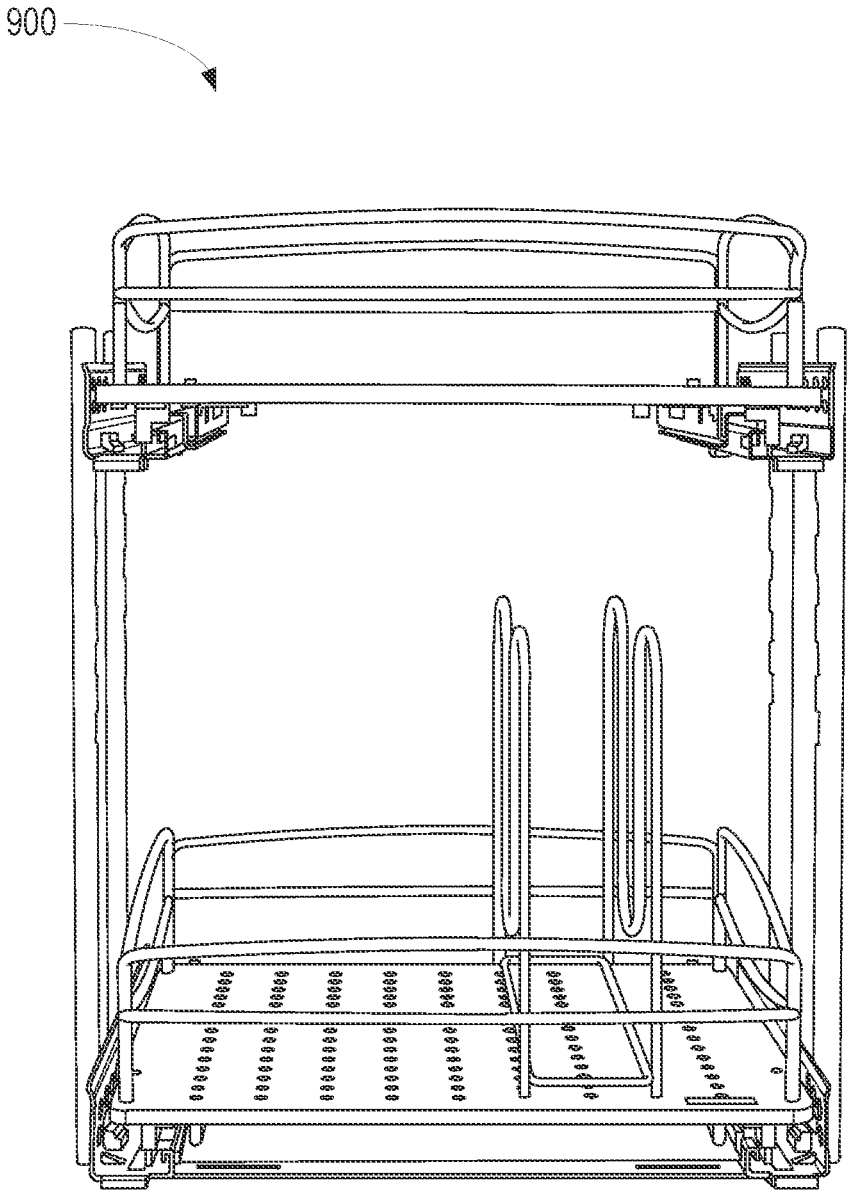
FIG. 21 is a perspective view of another example multi-level drawer cabinet storage system.

FIG. 1 is an example of a cabinet storage system 100, which may also be described as a single level drawer cabinet storage system. The cabinet storage system 100 may be mounted in a cabinet or other enclosure. As illustrated in the various examples of FIGS. 1-8 and 19, the cabinet storage system 100 includes a base 102. The base 102 may be a rigid material, such as metal, or wood, or engineered wood, and include apertures into which wires or rods may be frictionally mounted to provide dividers, shelves and/or organizer features on the base 102, as illustrated in FIG. 21.

Figure 3:
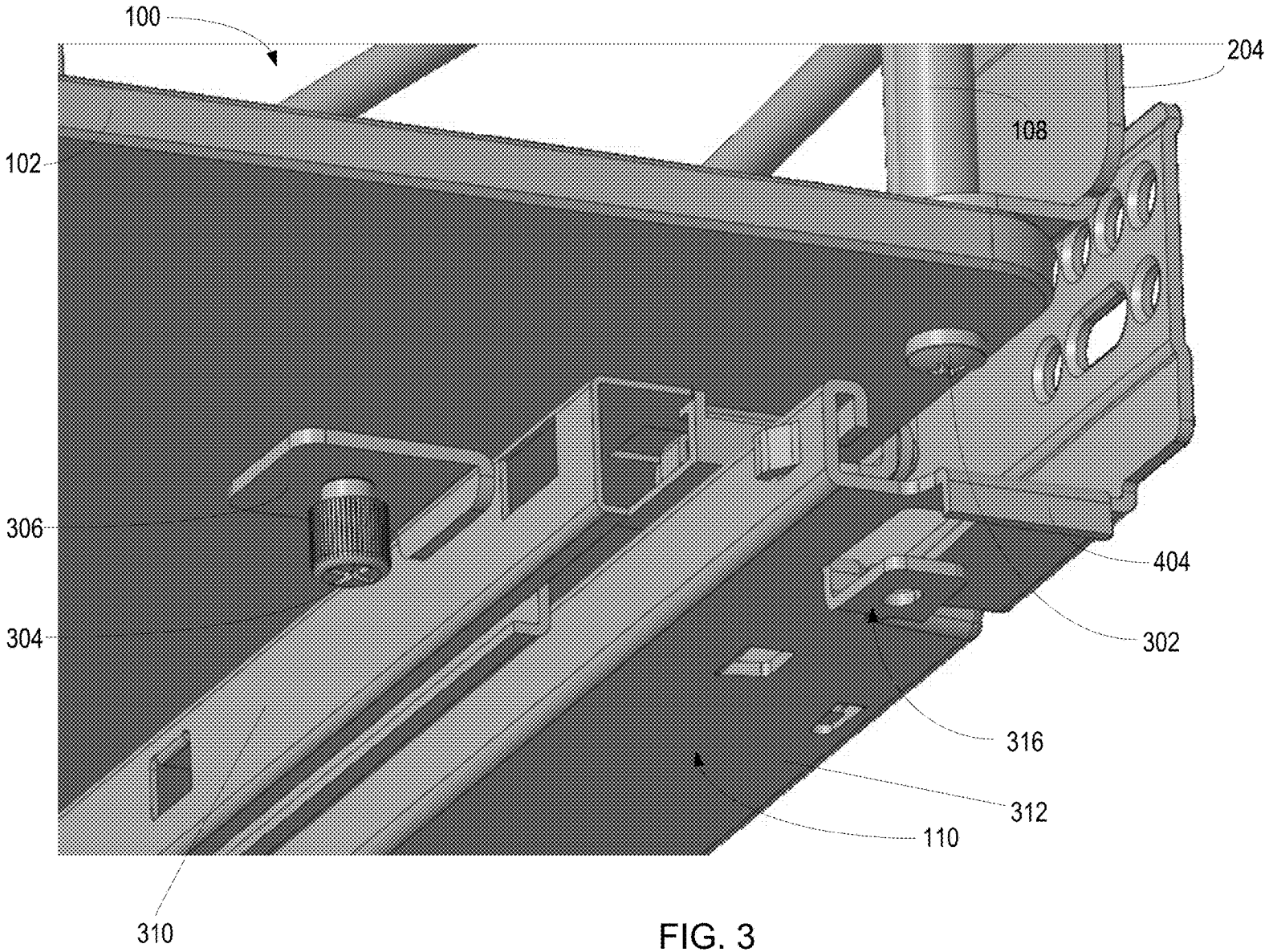
FIG. 3 is a perspective view of a bottom portion of another example cabinet storage system similar to the system of FIG. 1.
Figure 4:
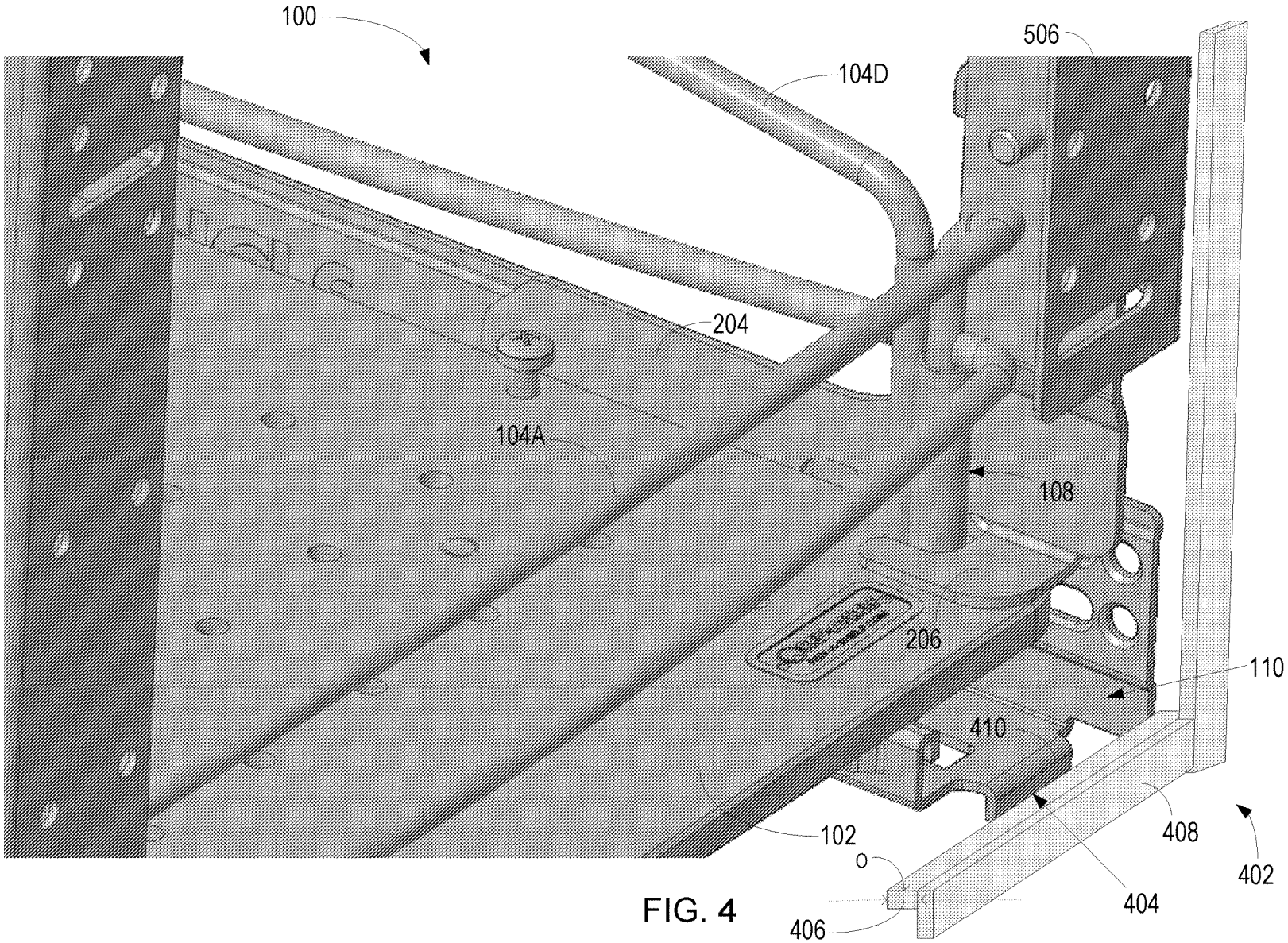
FIG. 4 is a perspective view of a portion of another example cabinet storage system similar to FIGS. 2-4.

The cabinet storage system 100 may include one or more fences 104 positioned around the perimeter of at least part of the base 102. In the illustrated example, the fences include front and rear fences 104A and 104B, respectively, and left and right side fences 104C and 104D, respectively. The front and rear fences 104A and 104B and the left side and right side fences 104C and 104D include vertical members holding horizontal members spaced away from the base 102. The base 102 may be described as a horizontal shelf having a horizontal planar surface. Structural columns 108 are coupled to the base 102 by fasteners 302 as illustrated in FIG. 3. The base 102, the fences 104 and the structural columns 108 may be made of wood, metal, plastic, composite, and/or any other rigid material. In an example, the base 102 is made of wood and the fences 104 and structural columns 108 are made of metal. In another example, base 102 is made of metal, such as in the form of wire. In other examples, other configurations of rigid materials may be used.

Figure 8:
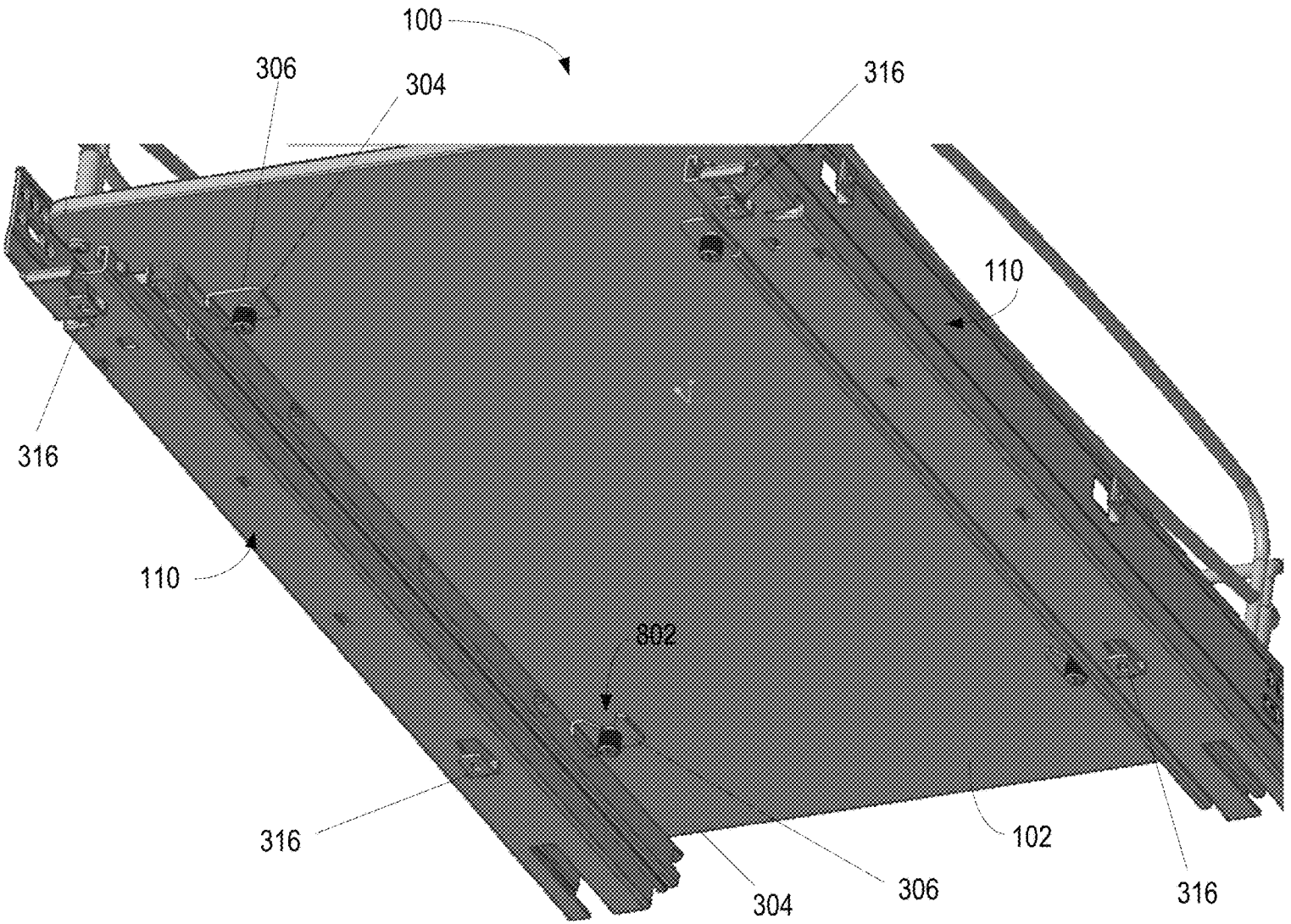
FIG. 8 is bottom perspective view of the example cabinet storage system of FIG. 1.

In an example, the structural columns 108 may be threaded sleeves at a first end that accommodate a threaded bolt such that the base 102 is compressed between the structural columns 108 and the fasteners 302 as the fasteners 302 are tightened as illustrated in the example of FIG. 3. The base 102 is coupled to a pair of slides 110 by fasteners 304, which extend through ears 306 fixedly coupled to each respective one of the slide members 110 and are threadly connected with the base 102 as illustrated in the examples of FIGS. 3 and 8. The fasteners 304 may be thumb screws mechanically tightened by hand using a grooved head of the fastener 304 or with a tool such as a screwdriver to removably and fixedly couple the base 102 to the slides 110. The ears 306 shown in FIG. 3 are the front ears, which are aligned with threaded apertures in the base 102 during installation of the slides 110. As illustrated in FIG. 8, the ears 306 at the rear of the base 102 are guide ears 306 that include an alignment notch 802, used to guide the base 102 into proper alignment with the slides 110 by installing the fasteners 304 in the base 102 and then sliding the base 102 forward to enter the alignment notch 802 and thereby align the slide 110 with the front ears 306 for installation of the respective fastener 304.

Each of the slide members 110 are telescoping slide members which include a slideable portion 310 and a fixed base portion 312. The slideable portion 310 is coupled with the base 102, and the fixed base portion 312 may be coupled with the bottom of the cabinet, so that the slidable portion 310 and the base 102 are movable together to extend away from the fixed base portion 312 in order to be positioned outside the cabinet in which the cabinet storage system 100 is mounted.

Figure 2:
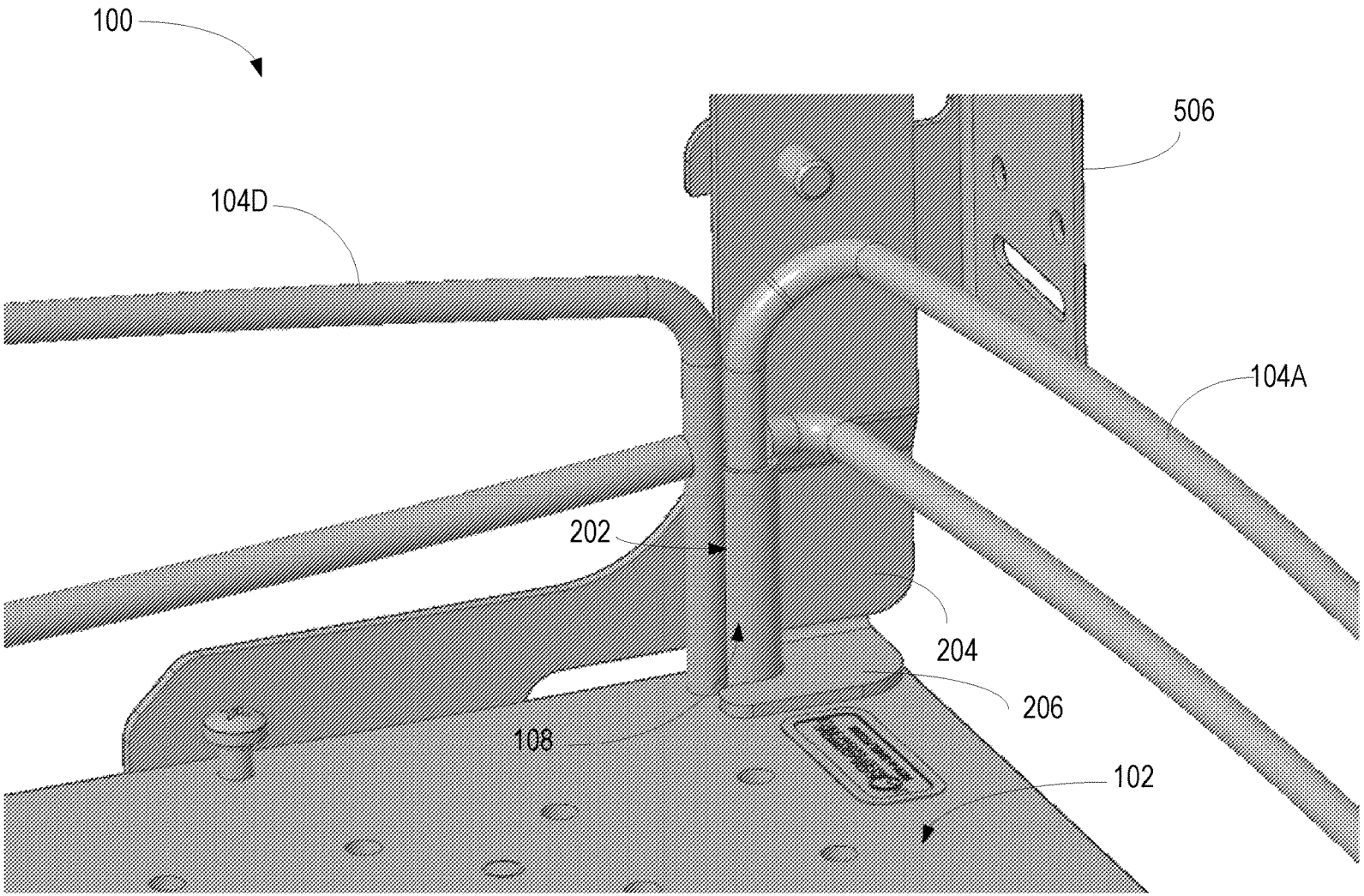
FIG. 2 is a perspective view of a top portion of another example cabinet storage system similar to the system of FIG. 1.

The structural columns 108 may be a cylindrical sleeve at a second end with appropriate diameter to receive and hold the front and rear fences 104A and 104B, such as by friction fit, as illustrated in FIGS. 1 and 2. As further illustrated in FIG. 2, the side fences 104C and 104D may be fixedly coupled to an outer surface of the structural columns 108 by a coupler 202, such as by a tack weld, braise, strap, fastener or some other holding mechanism. As illustrated in FIG. 1, the structural columns 108 at the rear of the cabinet storage system 100 extend further from the planar surface of the base 102 such that the side fences 104C and 104D are increasing spaced away from the planar surface of the base 102 as the side fences 104C and 104D extend from a front of the base 102 to a rear of the base 102. Also, the front and rear fences 104A and 104B, which are held in the cylindrical sleeves of the structural columns are interchangeable to minimize parts for manufacture.

Figure 5:
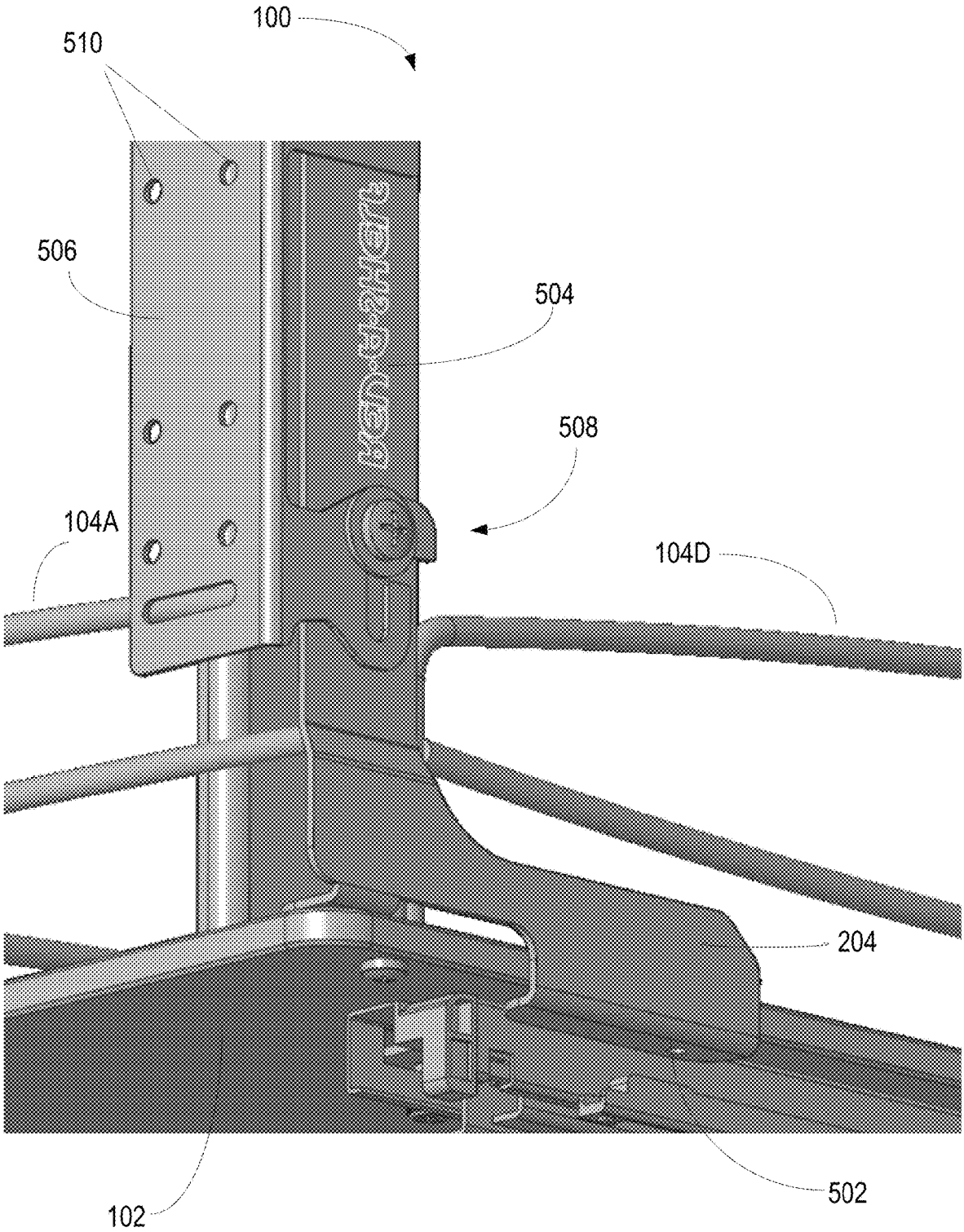
FIG. 5 is top perspective view of a portion of the example cabinet storage system of FIG. 1.
Figure 6:
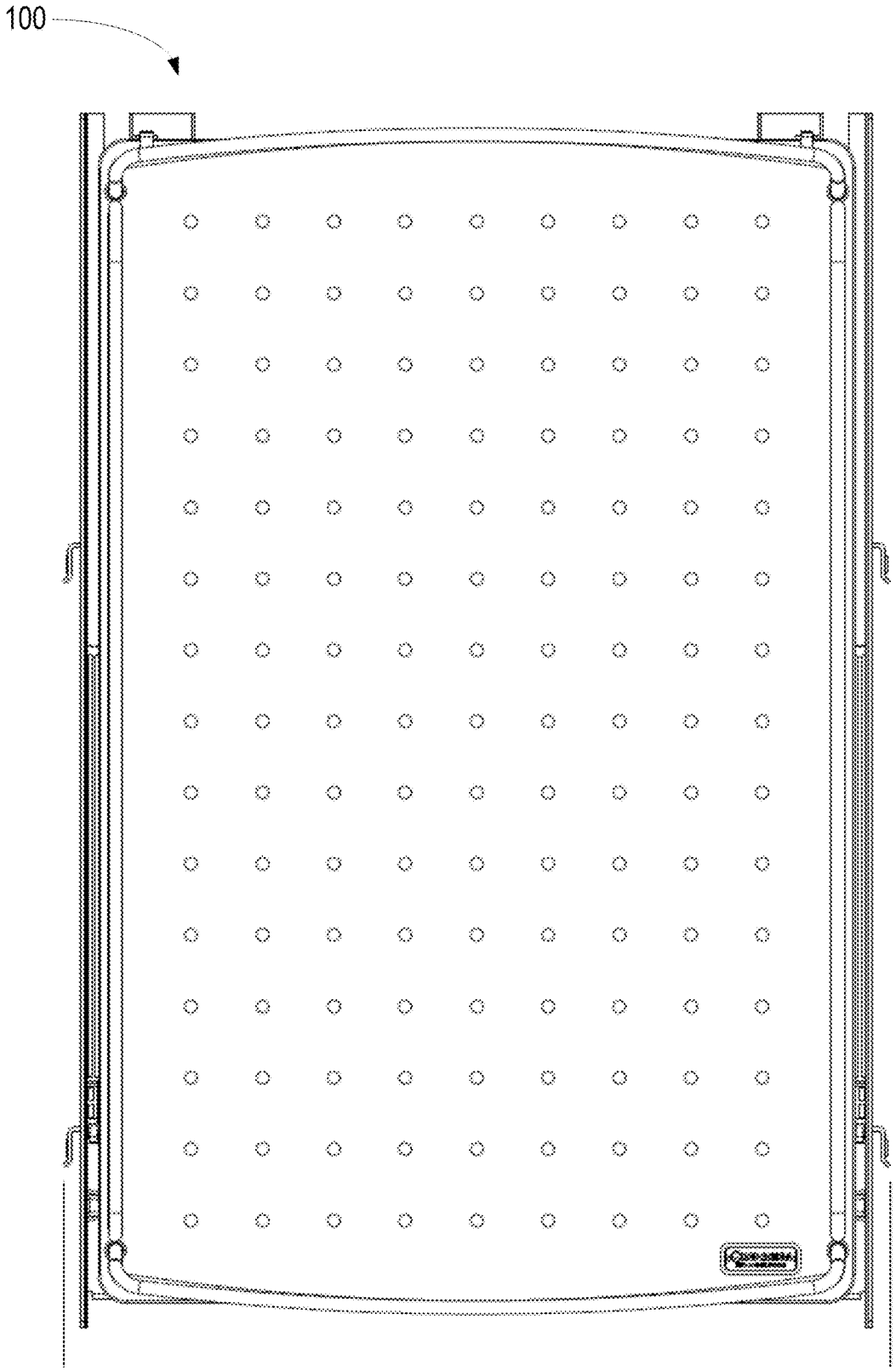
FIG. 6 is top view of the example cabinet storage system of FIG. 1.
Figure 7A:
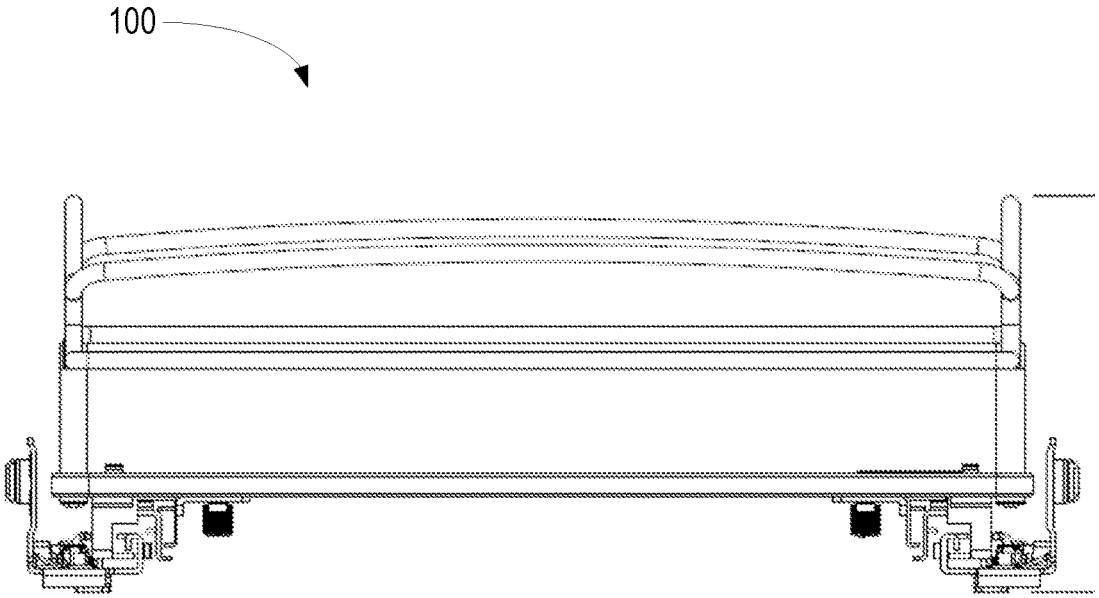
FIG. 7A is a front elevation view of the example cabinet storage system of FIG. 1.
Figure 7B:
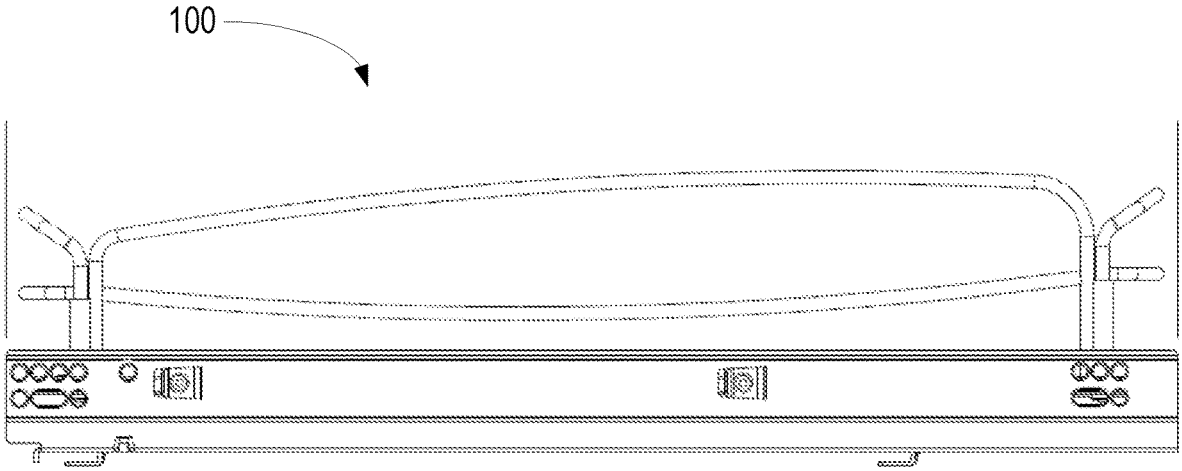
FIG. 7B is a side view of an example of the cabinet storage system of FIG. 1.

As illustrated in example of FIG. 2, the cabinet storage system 100 may also include a bracket 204 having an upper foot 206 that wraps the base 102 and is positioned contiguous with the planar surface of the base 102. As illustrated in the example of FIG. 5, the bracket 204 also includes a lower foot 502, which contiguously aligns with a lower planar surface of the base 102, such that the bracket 204 wraps around the base 102, which is fixedly held between the upper foot 206 and the lower foot 502. In this configuration, the bracket 204 provides horizontal, vertical and torsional support for the cabinet storage system 100. The bracket 204 also includes a vertical strut 504 and a face frame bracket 506. As illustrated in FIG. 5, the face frame bracket 506 is adjustable vertically one the vertical strut 504 by a finger slot 508 held against the face frame bracket by a releasable fastener, such as a threaded screw. The face frame bracket 506 includes a plurality of apertures 510, any one or more of which are available to couple a cabinet front, such as a drawer front or a door front to the cabinet storage system 100.

As illustrated in 4, the cabinet storage system 100 may be positioned in a cabinet such that a face frame 402 of the cabinet is aligned in the same plane with a front face of the face frame bracket 506. In this way, a front face, such as a drawer or door coupled with the face frame bracket 506 may also be in alignment with the face frame 402. Alignment of the cabinet storage system 100 such that a front planar surface of the face frame bracket 506 occupies the same plane with the face frame 402 of the cabinet may be accomplished using a face frame lip standoff 404 extending from a front edge of the slide 110 a predetermined distance. The face frame lip standoff 404 may butt up against a lip or rail 406 coupled with the bottom of the cabinet and abutting an inner surface of a lower face frame portion 408 of the face frame 402. When the face frame lip standoff 404 is butted against the rail 406, the planar surface of the face frame bracket 506 may extend a predetermined offset (O) distance beyond a contact surface 410 of the face frame lip standoff 404. The predetermined offset (O) is equal to the width of the rail 406 and the face frame bottom portion 408. Accordingly, a cabinet front, such as a drawer front or a door front, coupled with the face frame bracket 506 may be aligned with the face frame 402 of the cabinet. In cabinets without a face frame, the predetermined offset (O) may be the width of the rail 406 such that the cabinet front aligns with the front edges of the cabinet box. Accordingly, during installation of the cabinet storage system 100 in a cabinet, butting the face frame lip standoff 404 against the rail 406 automatically aligns a later installed front face, such as a drawer front or door front, with the face frame of the cabinet or the cabinet box itself where the face frame is omitted.

The fixed base portion 312 of the slides 110 of the cabinet storage system 100 may be coupled with the bottom of a cabinet. In order for the rail and face frame (if present) to not interfere with the slide action as the cabinet storage system 100 is slide between the inside and the outside of the cabinet, the slides 110 may include feet 316 as illustrated in FIGS. 3 and 8. The feet 316 may provide a vertical clearance of the slides 110 above the bottom of the cabinet.

Figure 9:
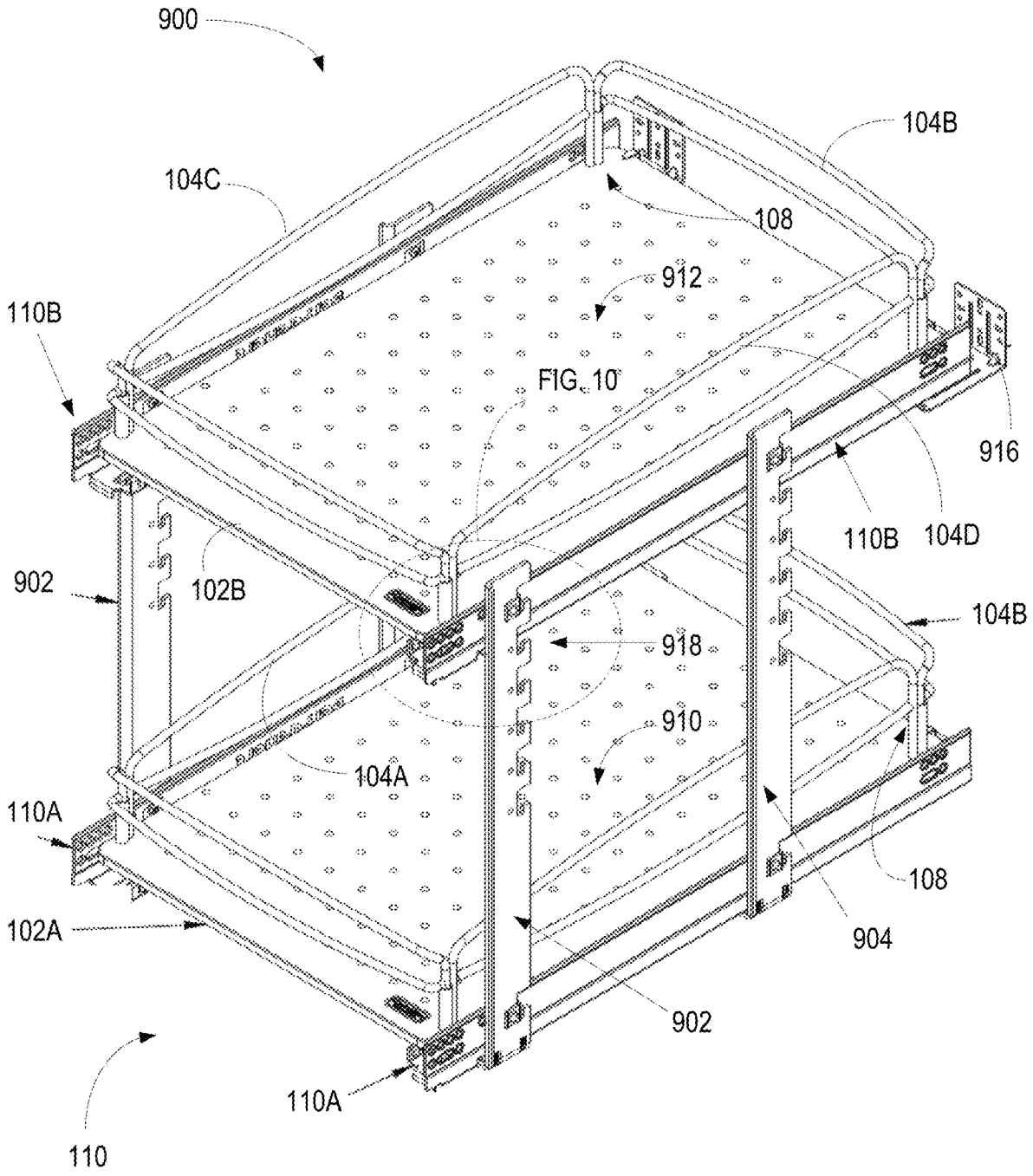
FIG. 9 is a perspective view of another example cabinet storage system.

FIG. 9 is a perspective view of another example cabinet storage system 900. The cabinet storage system 900 in FIG. 9 may be described as a multi-level cabinet storage system 900. The cabinet storage system 900 may include multiple bases 102A and 102B, fences 104, structural columns 108, and slides 110. Unless otherwise indicated, the features and functionality of the cabinet storage system 100 discussed with reference to FIGS. 1-8 are similar to the features and functionality of the cabinet storage system 900 discussed with reference to FIGS. 9-13. Accordingly, for purposes of brevity the details of these features and functionality will not be fully repeated, and it should be understood that features and functionality are fully interchangeable, combinable, and/or useable in the example systems described herein.

The bases 102A and 1026, or shelves, are fixedly coupled between the front and rear vertical opposing members 902 and 904 such that the planar surfaces of the bases 102 are transversely aligned with vertical planes defined by the front and rear vertical members 902 and 904. The bases 102 include a first drawer 910, or lower drawer, proximate a base of the multi-level storage container 900, and one or more upper drawers 912, or second drawer, vertically spaced above the first drawer 910. In the example of FIG. 9, two drawers are illustrated. In other examples, any number of one or more upper drawers may be vertically positioned above the bottom drawer 910.

The multi-level storage system 900 also includes a set of slide members 110A positioned on opposing sides of the lower drawer 910 and a set of slide members 110B positioned on opposing sides of the upper drawer 912. The opposing sides are represented by the side edges of the multi-level storage system 900, which may include lateral opposing edges of the drawers 910 and 912. The each set of slide members 110 include a first slide member and a second slide member. The first set of slide members 110A are coupled with the base 102A of the lower drawer 910 and the second set of slide members 110B is coupled with the base 102 of the upper drawer 912 of the multi-level cabinet storage container 900. The second set of slide members 912 are also coupled with brackets 916 for coupling the cabinet storage system 900 to a rear wall of a cabinet.

Figure 10:
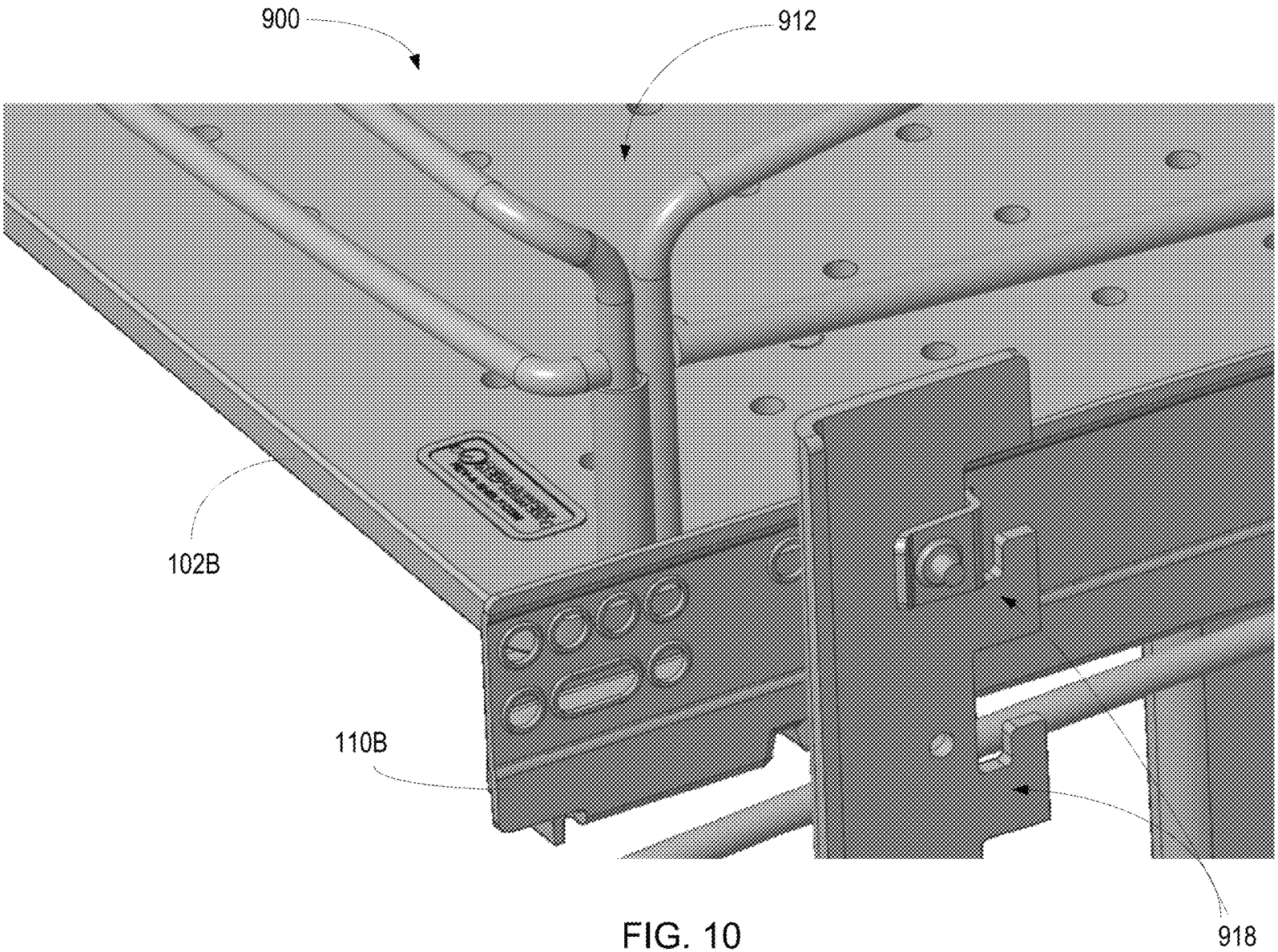
FIG. 10 is a perspective view of a top portion of another example cabinet storage system similar to the system of FIG. 9.
Figure 11:
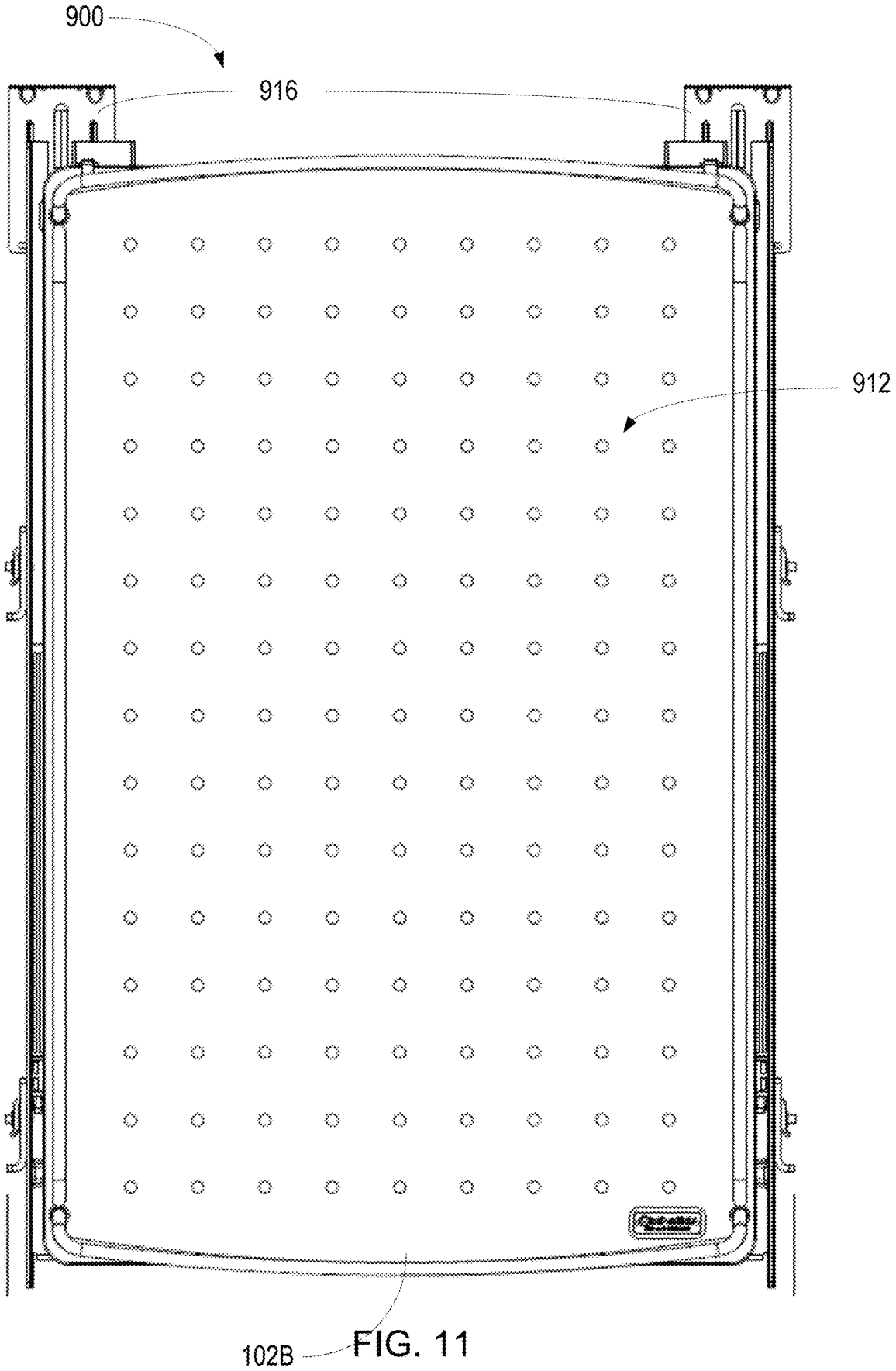
FIG. 11 is top view of the example cabinet storage system of FIG. 9.

The front and rear vertical opposing members 902 and 904 are coupled with the first set of slides 110A and the second set of slides 110B. The first set of slides 110A are fixedly coupled with the front and rear vertical opposing members 902 and 904. As illustrated in FIGS. 9 and 10, the second set of slides 912 are adjustably coupled with the front and rear vertical opposing members 902 and 904 by adjustable brackets 918 such that the upper drawer 912 is adjustable to a number of different heights above the lower drawer 910. In addition, or alternatively, additional upper drawers 912 may be separately coupled with the front and rear vertical opposing members 902 and 904 by the adjustable brackets 918.

Figure 12:
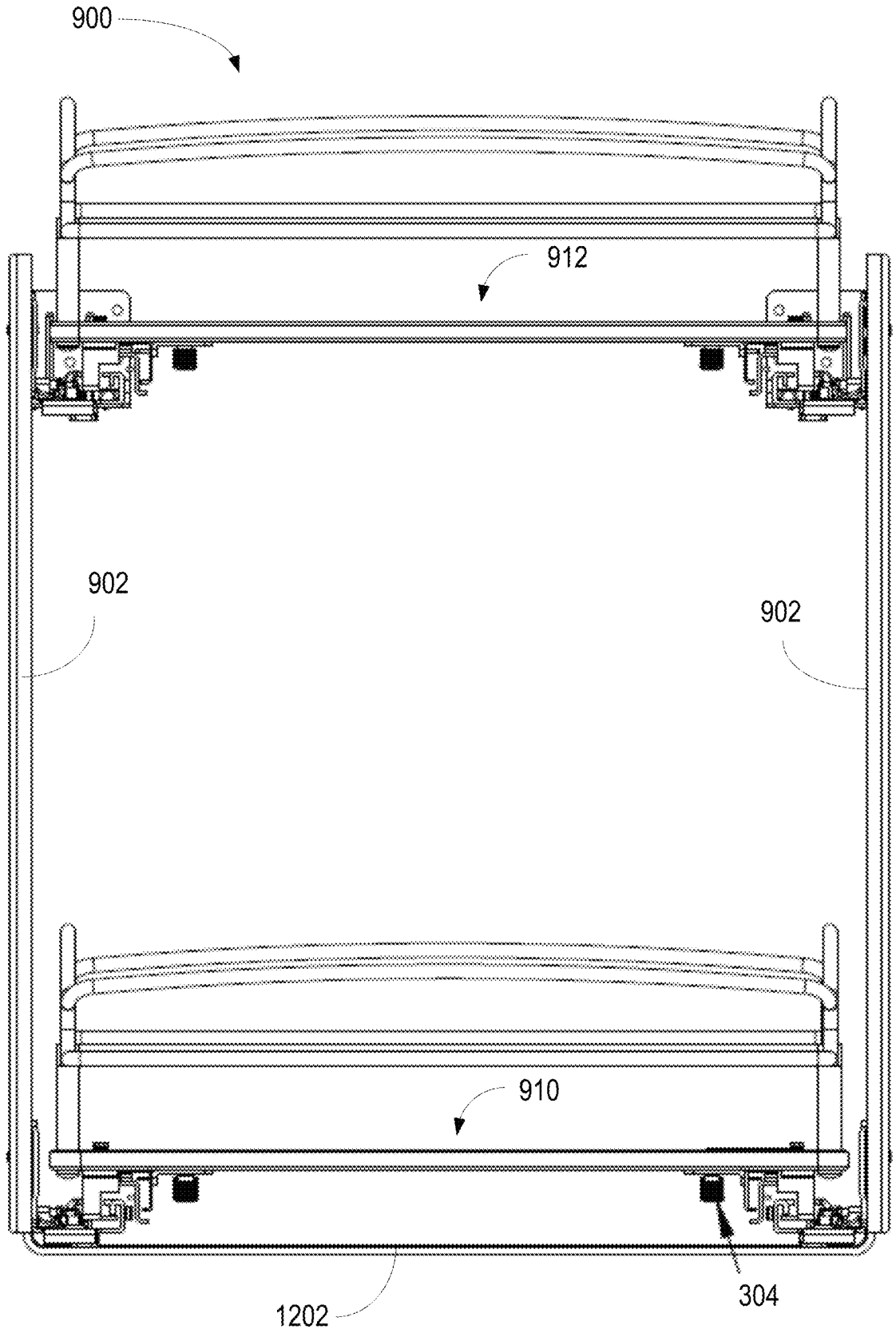
FIG. 12 is a front elevation view of the example cabinet storage system of FIG. 9.
Figure 13:
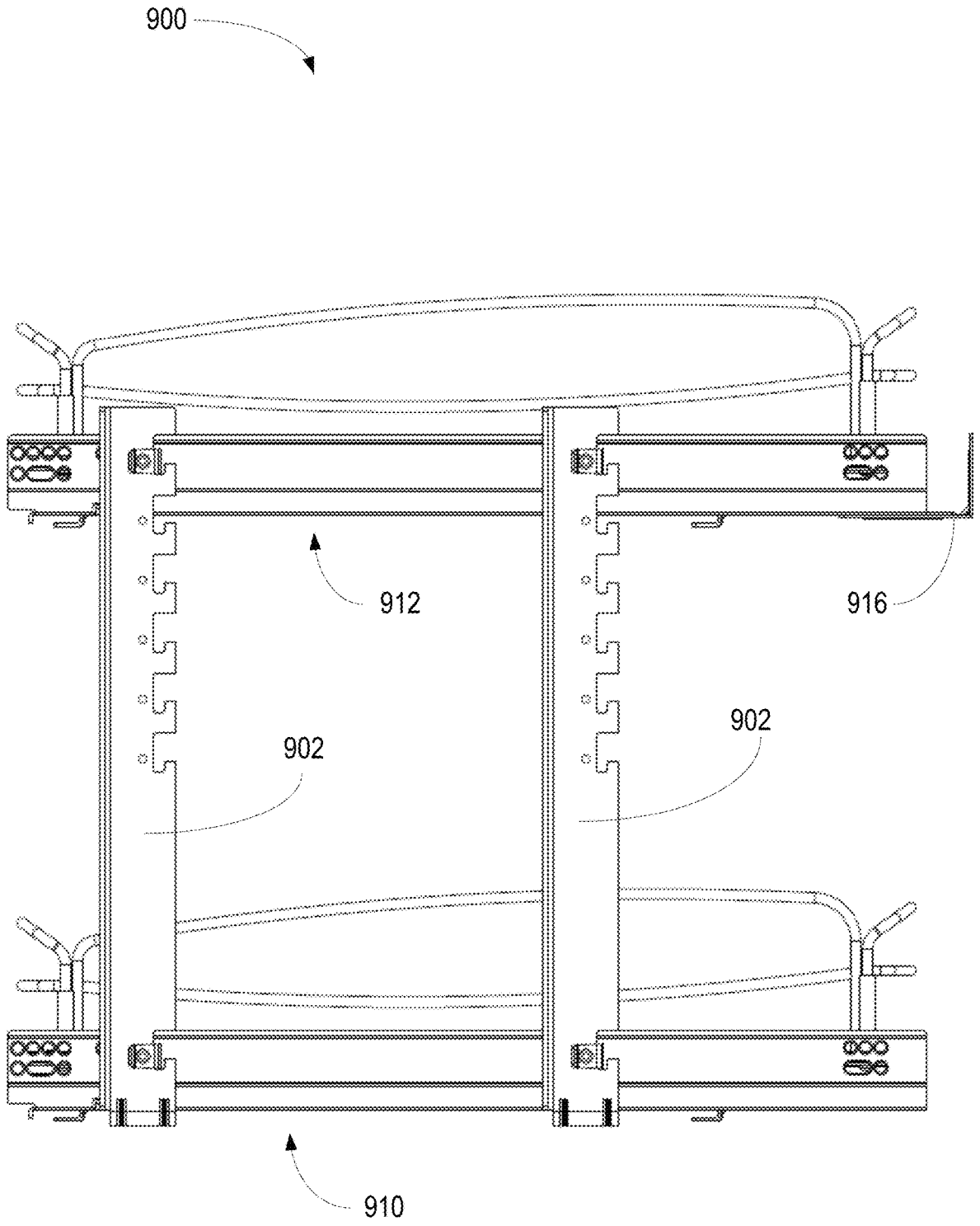
FIG. 13 is a side view of an example of the cabinet storage system of FIG. 9.

As illustrated in FIGS. 12 and 13, the front and rear vertical opposing members 902 and 904 may extend to the set of slide members 110A coupled with the lower shelf 910 and be coupled with a horizontal strut 1202. The strut 1202 may extend between the slides 110A and include apertures to allow coupling to the bottom of a cabinet in which the cabinet storage system 900. The strut 1202 may provide structural support for the first and second drawers 910 and 912, and may raise the first pair of slides 110A off the bottom of the cabinet. Accordingly, in the example of FIG. 12, the feet 316 may be omitted from the pair of slides 110A, or not used. In other examples first and second drawers 910 and 912 may have other forms of structural support, the strut 1202 may be omitted, and the feet 316 may be used to raise the height of cabinet storage system 900 to clear a face frame and/or rail included at the bottom of the cabinet.

Figure 14:
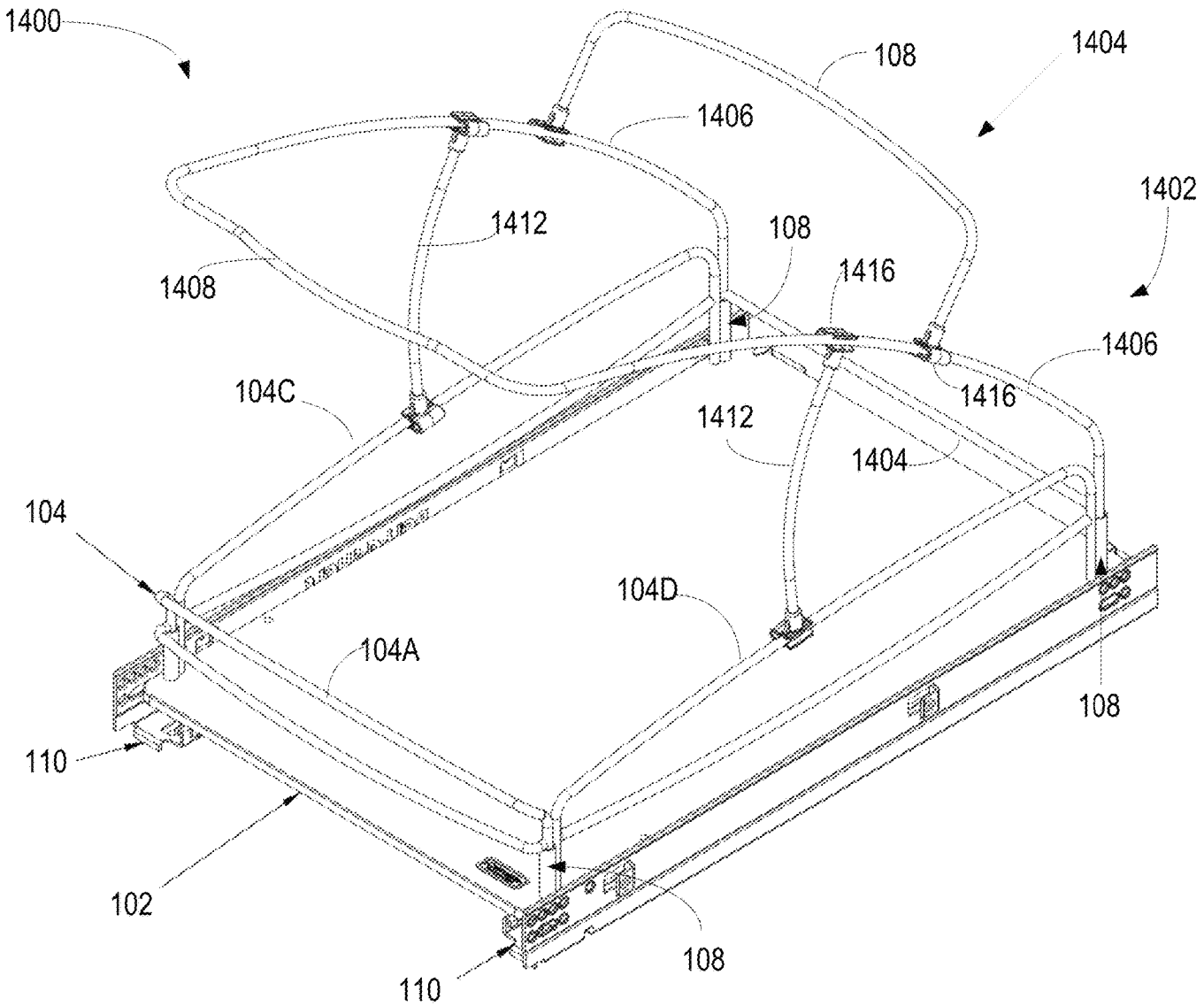
FIG. 14 is a perspective view of another example cabinet storage system.
Figure 15:
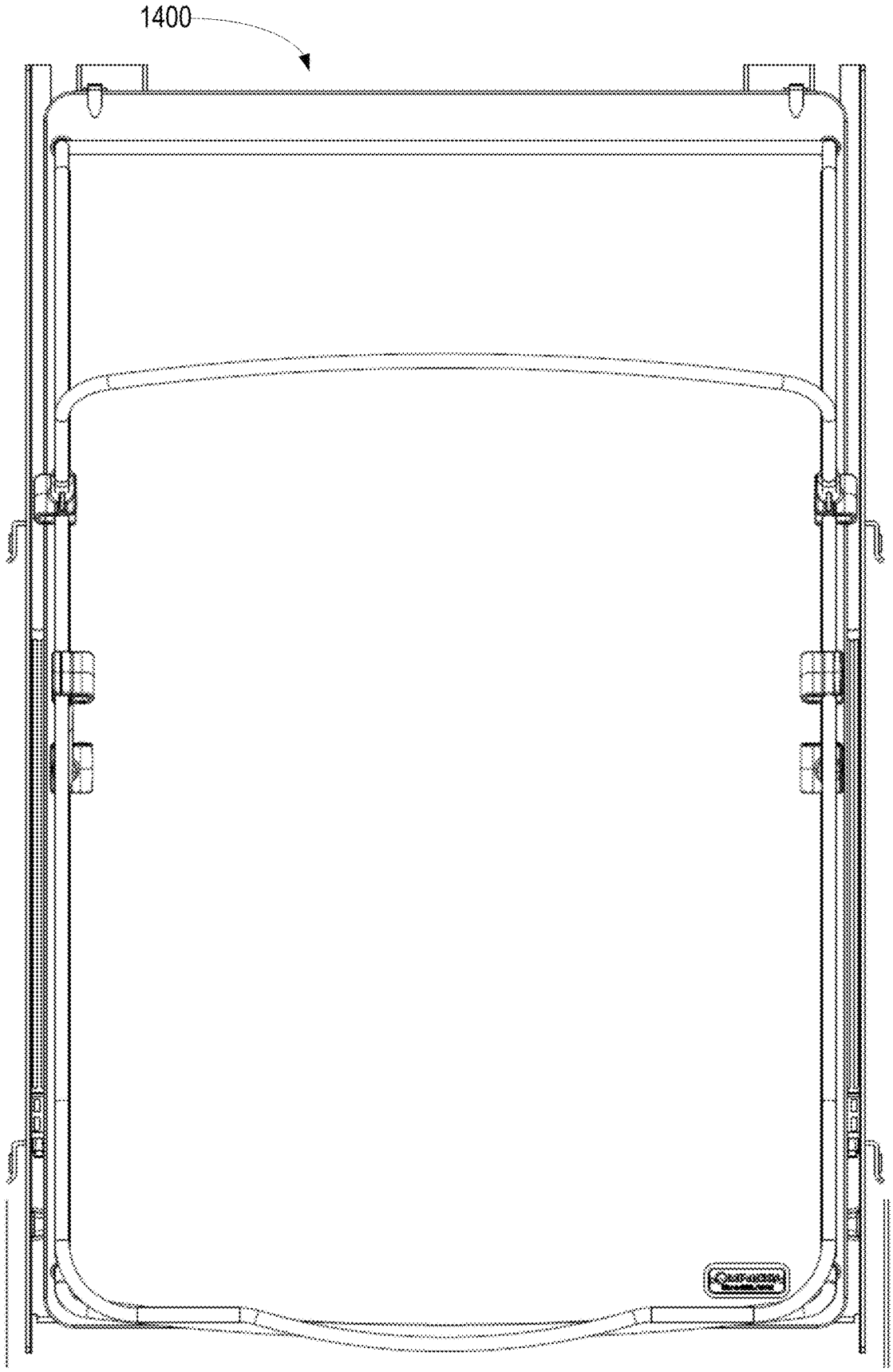
FIG. 15 is top perspective view of the example cabinet storage system of FIG. 14.
Figure 16:
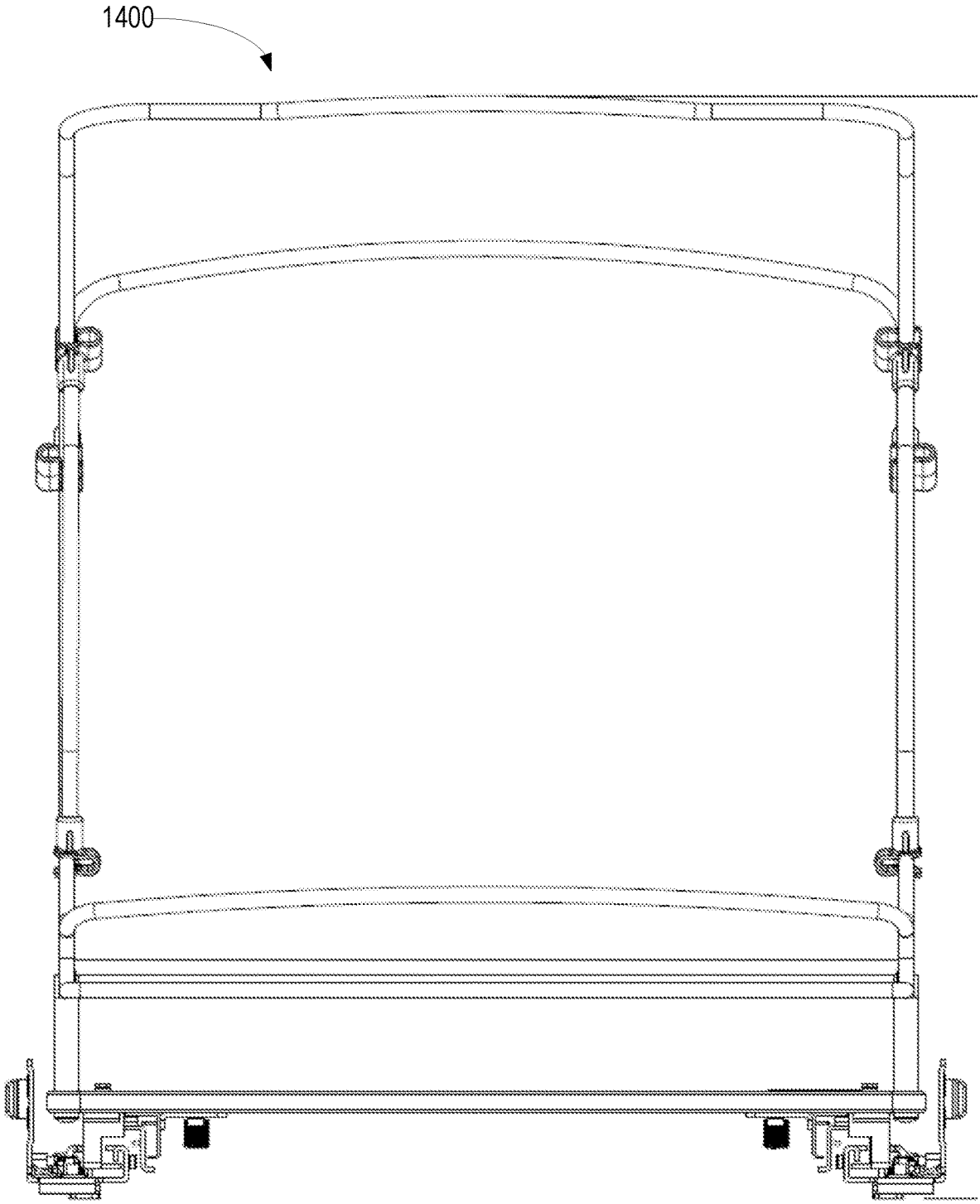
FIG. 16 is a front elevation view of the example cabinet storage system of FIG. 14.
Figure 17:
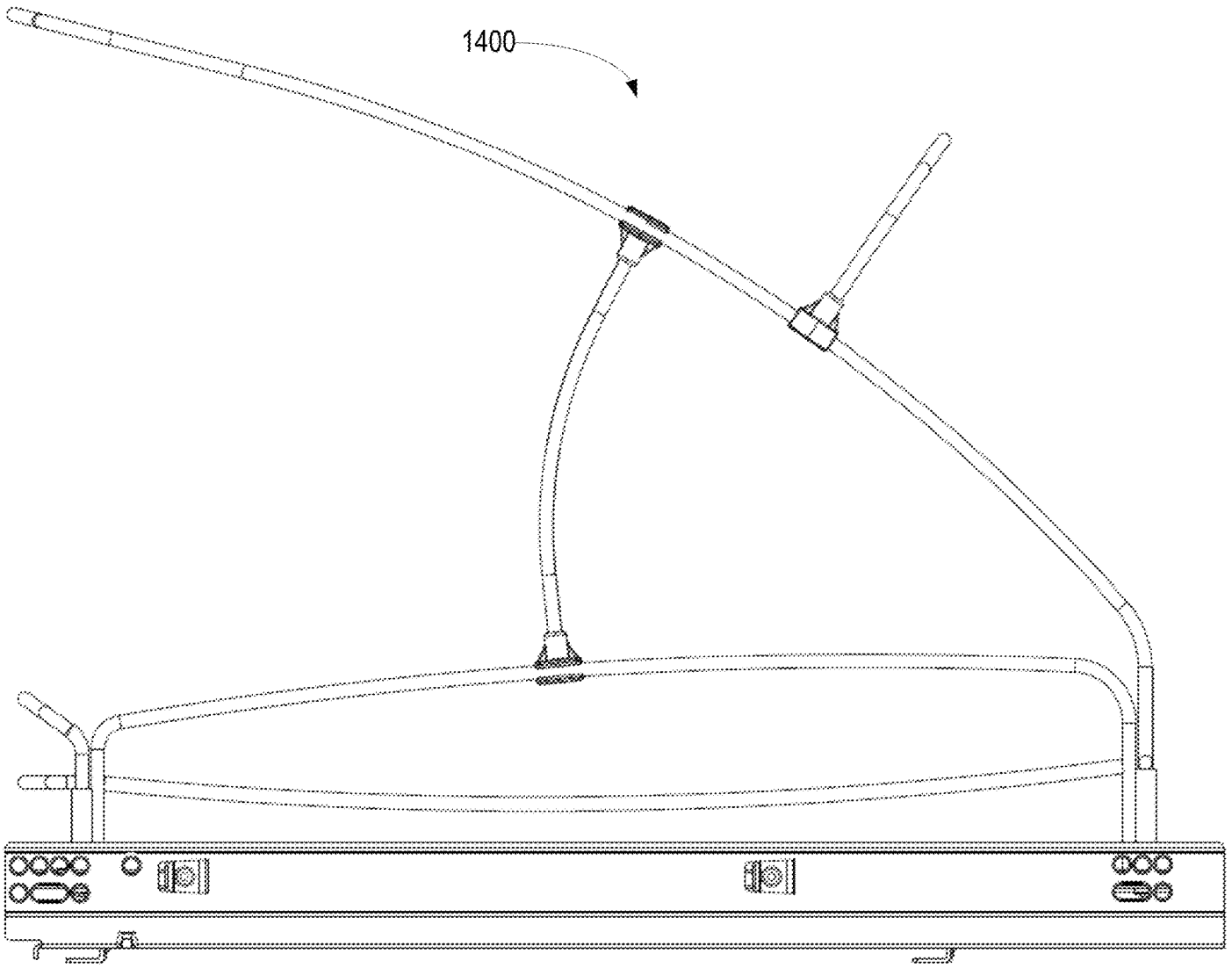
FIG. 17 is a side view of an example of the cabinet storage system of FIG. 14.

FIG. 14 is a perspective view of another example cabinet storage system 1400. The cabinet storage system 1400 may also be referred to as a slide-out cabinet storage system for a waste bin. Referring to FIGS. 14-18 and 20, the cabinet storage system 1400 may include the base 102, the fences 104 the structural columns 108 and the slides 110. Unless otherwise indicated, the features and functionality of the cabinet storage system 100 discussed with reference to FIGS. 1-8 and 19, and the cabinet storage system 900 discussed with reference to FIGS. 9-13 and 21 are similar to the features and functionality of the cabinet storage system 1400 discussed with reference to FIGS. 14-18 and 20. Accordingly, for purposes of brevity the details of these features and functionality will not be fully repeated, and it should be understood that features and functionality are fully interchangeable, combinable, and/or useable in the example systems described herein.

In the example of FIG. 14, the example cabinet storage system 1400 includes a front fence 104A, and opposing sides fences 104C and 104D each of which include horizontally extending top and bottom members that are generally parallel. In this example, the rear fence 1402 includes a single horizontal member 1404 extending between the structural columns 108 generally parallel with the base 102. In addition, the rear fence 1402 includes a cantilevered keeper 1404 as illustrated in FIGS. 14-17. The cantilevered keeper 1404 includes to side members 1406 and a handle member 1408. The side members 1406 extending from the structural columns 108 at the back of the cabinet storage system 1400 vertically and toward the front of the cabinet storage system 1400 above the respective side fences 104C and 104D. The handle member 1408 may be suspended vertically above the front fence 104A and generally parallel with the two members forming the front fence 104A. A pair of struts 1412 may be coupled between side fences 104C and 104D and the side members 1406 by fasteners 1416 to provide structural support to the cantilevered keeper 1404. A rear bracket 108 may also be coupled with side members 1406 by fasteners 1416.

Figure 18:
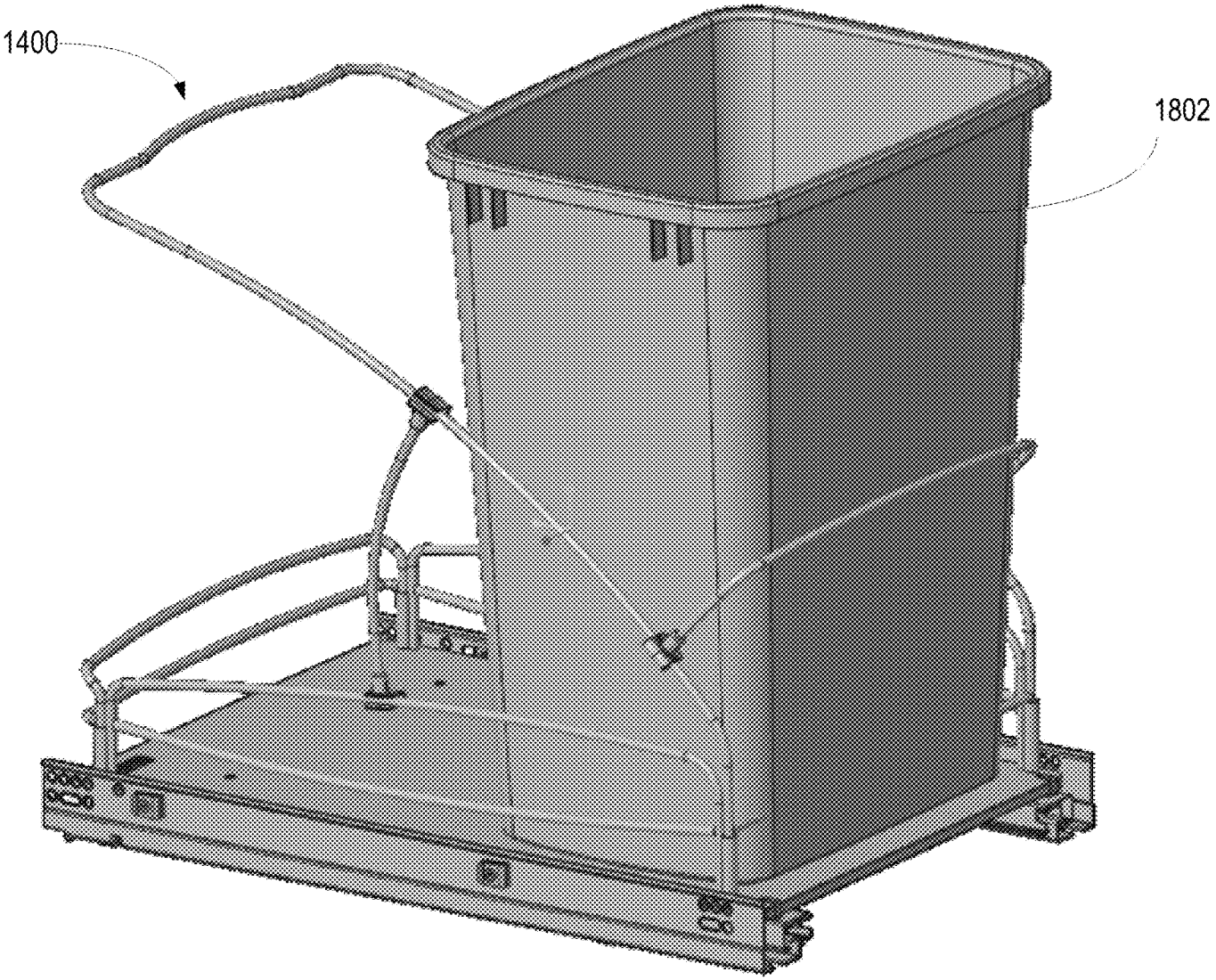
FIG. 18 is a perspective view of another example of a cabinet storage system.
Figure 19:
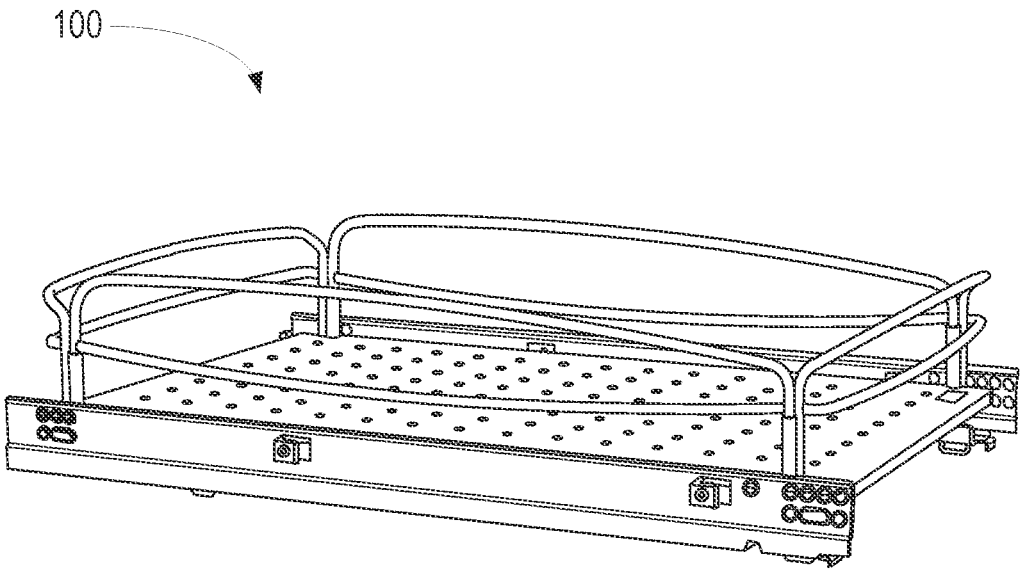
FIG. 19 is a perspective view of an example single drawer cabinet storage system.
Figure 20:
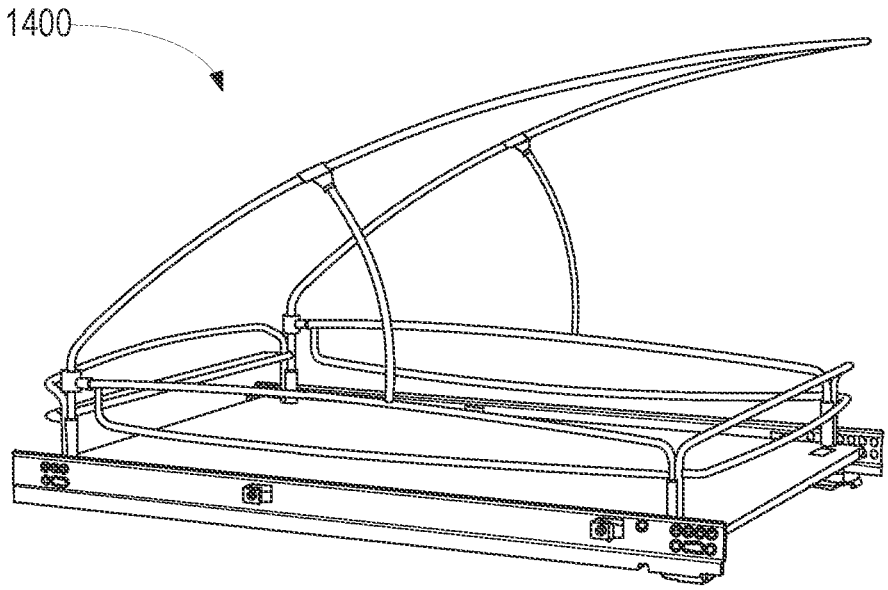
FIG. 20 is a perspective view of another example of a slide out cabinet storage system.

The cantilevered keeper 1404 may be sized and shaped to receive at least one container 1802 as illustrated in FIG. 18. The at least one container may be maintained in position on the base 102 as the base 102 is slid in and out of a cabinet by the cantilevered keeper 1404. In addition, the handle member 1404 may be used to actuate the slides 110 to move the base 102 by grabbing and pulling or pushing the cantilevered keeper 1404.

Figure 22:
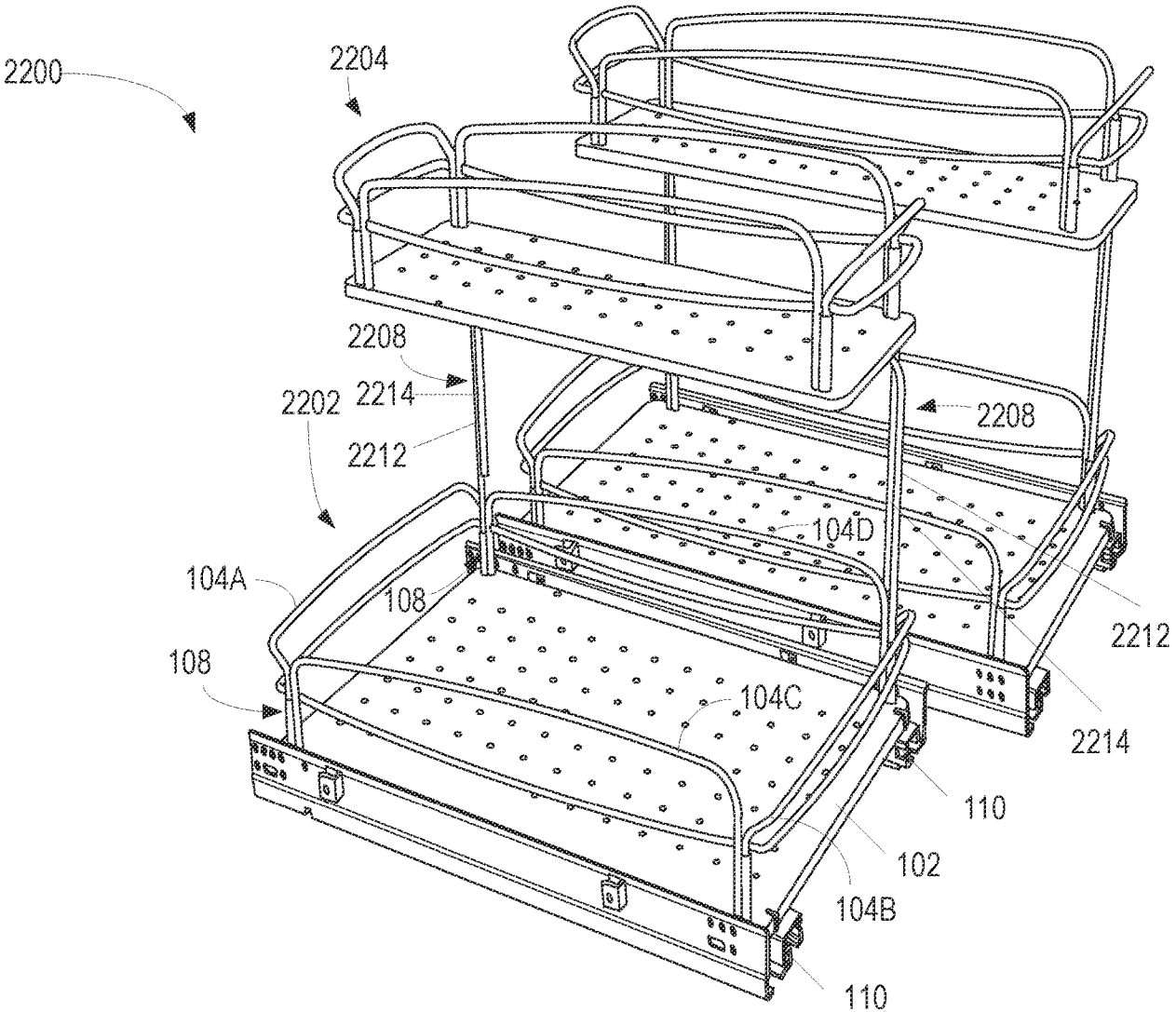
FIG. 22 is a perspective view of another example a single drawer upper shelf cabinet storage system.

FIG. 22 is another example cabinet storage system 2200 that includes a large shelf 2202 positioned as the lower drawer, and a smaller shelf 2204 positioned as an upper shelf. The cabinet storage system 2200 of FIG. 22 may also be described as a single drawer upper shelf cabinet storage system. In FIG. 22, two cabinet storage systems 2200 are illustrated providing examples of different sizes of the large shelf 2202 and the smaller upper shelf 2204. Unless otherwise indicated, the features and functionality of the cabinet storage system 100 discussed with reference to FIGS. 1-8 and 19, the cabinet storage system 900 discussed with reference to FIGS. 9-13 and 21, and the cabinet storage system 1400 discussed with reference to FIGS. 14-18 and 20 are similar to the features and functionality of the cabinet storage system 2200 discussed with reference to FIG. 22. Accordingly, for purposes of brevity the details of these features and functionality will not be fully repeated, and it should be understood that features and functionality are fully interchangeable, combinable, and/or useable in the example systems described herein.

The cabinet storage system 2200 includes a base 102, a pair of slides 110 a front fence 104A, a rear fence 104B and side fences 104C and 104D coupled with the base 102 by structural columns 108. In this example, the front fence 104A and the rear fence 104B each include a two horizontal substantially parallel members extending along a perimeter of the base 102 and held by friction fit in respective structural columns 108. In addition, side fences 104C and 104D each with two substantially parallel members fixedly coupled with the outer surface of the structural columns 108 and extending along a perimeter of the base 102.

Only one of the front fence 104A and the rear fence 1048 also include a upper shelf support member 2208. The upper shelf support member 2208 includes a first support member 2212 extending along the underside of the upper shelf 2204 parallel to the side fence 104D, and a second support member 2214 coupled with the structural column 108 of the upper shelf 2204.

It is now apparent that there are many advantages of the cabinet storage system provided herein. In addition to the advantages that have been described, it is also possible that there are still other advantages that are not currently recognized but which may become apparent at a later time.

While preferred embodiments of the cabinet storage system have been described, it should be understood that the disclosure is not limiting, and modifications may be made without departing from the features and functionality described. The scope of the disclosure is defined by the appended claims, and all devices that come within the meaning of the claims, either literally or by equivalence, are intended to embrace them.

What is claimed is:

1. A cabinet storage system for a cabinet comprising:

a base having a surrounding peripheral edge;

a pair of slides coupled with a first planar surface of the base;

a plurality of structural columns abutting and extending away from a second planar surface of the base, each of the structural columns comprises a threaded sleeve at a first end and a cylindrical sleeve at a second end, the first and second planar surfaces being opposing planar surfaces of the base, and the structural columns positioned on the second planar surface at the surrounding peripheral edges of the base; and a plurality of fences, each of the fences coupled with the structural columns away from the base and extending along the surrounding peripheral edge of the base away from the second planar surface and the cylindrical sleeve at the second end has a diameter to receive and frictionally hold an end of one of the fences such that the structural columns and the fences extend perpendicularly from a surface of the base.

2. The cabinet storage system of claim 1, further comprising a threaded fastener having a threaded portion and extending through the base, the threaded fastener threadedly coupled with the threaded sleeve.

3. The cabinet storage system of claim 2, wherein the threaded portion of the threaded sleeve abuts the base such that the base is compressed between the threaded fastener and the threaded sleeve.

4. The cabinet storage system of claim 1, wherein the plurality of fences include a first fence and a second fence each having opposing ends, and wherein the cylindrical sleeve includes an inner surface and an outer surface, the cylindrical sleeve formed to receive one of the opposing ends of the first fence such that the first fence contiguously contacts the inner surface, and one of the opposing ends of the second fence is fixedly coupled to the outer surface by a coupler.

5. The cabinet storage system of claim 4, wherein the one of the opposing ends of the first fence is fixedly held in contact with the inner surface of the cylindrical sleeve by friction fit and the coupler is a weld.

6. A cabinet storage system comprising:

a base comprising a first planar surface and a second planar surface, the first and second planar surfaces being opposing surfaces of the base and defining a perimeter of the base;

a pair of slides coupled with the first planar surface;

a plurality of fences positioned away from the second planar surface around the perimeter of the base, wherein the plurality of fences include a first fence positioned to extend longitudinally along a first perimeter edge of the base and a second fence separate from the first fence, the second fence positioned to longitudinally extend along a second perimeter edge of the base that is different from the first perimeter edge; and a plurality of structural columns mechanically coupled with the base and abutting the second planar surface, the structural columns longitudinally extending away from the second planar surface and rigidly maintaining the plurality of fences positioned away from the second planar surface around the perimeter of the base, wherein the first fence is fixedly coupled with an outer surface of one of the structural columns, and a portion of the second fence is disposed in an aperture formed in an end of the one of the structural columns.

7. The cabinet storage system of claim 6, wherein the structural columns longitudinally extend to a first height along a first perimeter edge of the base and the structural columns longitudinally extend to a second height along a second perimeter edge of the base, the first height being greater than the second height, and the first perimeter edge being opposite the second perimeter edge.

8. The cabinet storage system of claim 6, wherein the structural columns are cylindrical with a first end abutting the second planar surface having a threaded aperture, and a second end having an aperture sized to receive an end of one of the fences.

9. The cabinet storage system of claim 8, further comprising a plurality of threaded fasteners, wherein the base includes a respective aperture aligned with the threaded aperture in each of the structural columns, and the threaded fasteners extend through the respective apertures included in the base and threadedly engage with the threaded aperture of the structural columns.

10. The cabinet storage system of claim 6, wherein the first fence is welded to the outer surface of the one of the structural columns, and the portion of the second fence disposed in the aperture formed in the end of the one of the structural columns is fixedly held therein by friction fit.

11. The cabinet storage system of claim 6, wherein the perimeter of the base is rectangular, and a respective structural column is positioned at each corner of the base.

12. A cabinet storage system comprising:

a plurality of fences, each of the plurality of fences being a separate continuous member having a central horizontal member portion, a first vertical member end portion and a second vertical member end portion, the first and second vertical member end portions forming opposite ends of a respective fence and vertically extending away from the central horizontal member portion;

a plurality of structural columns, each of the structural columns having either the first vertical member end portion or the second vertical member end portion of one of the respective fences fixedly coupled with an outer surface of respective structural columns, and the first vertical member end portion or the second vertical member end portion of an other one of the respective fences positioned in an aperture formed in a first end of each of the respective structural columns; and a base coupled with and abutting a second end of each of the respective structural columns, the base also coupled with a pair of slides.

13. The cabinet storage system of claim 12, wherein the base includes a first horizontal planar surface abutted by the structural columns, and a second horizontal planar surface to which the pair of slides are coupled, the first horizontal planar surface and the second horizontal planar surface being opposing horizontal planar surfaces of the base.

14. The cabinet storage system of claim 13, further comprising a fastener extending through the first horizontal planar surface and the second horizontal planar surface and into an aperture included in the second end of each of the respective structural columns.

15. The cabinet storage system claim 14, wherein the fastener is a threaded fastener and the aperture in the second end of the respective structural columns is a threaded aperture.

16. The cabinet storage system of claim 12, wherein the fences comprise a front fence, a rear fence, and opposing side fences, and either the first vertical member end portion or the second vertical member end portion of respective side fences are fixedly coupled with the outer surface of the respective structural columns, and the first vertical member end portion or the second vertical member end portion of the front fence and rear fence are positioned in the aperture formed in the first end of each of the respective structural columns.

* * * * *